United States Patent [19]

Naruse et al.

[11] Patent Number: 4,791,792

[45] Date of Patent: Dec. 20, 1988

[54] ICE MAKING MACHINE

[75] Inventors: Nobutaka Naruse; Shozo Ogata, both of Toyoake, Japan

[73] Assignee: Hoshizaki Electric Co., Ltd., Toyoaki, Japan

[21] Appl. No.: 909,104

[22] Filed: Sep. 18, 1986

[30] Foreign Application Priority Data

Sep. 27, 1985 [JP] Japan ..... 60-212284

[51] Int. Cl.[4] ..... F25C 5/10

[52] U.S. Cl. ..... 62/135; 62/347; 62/352

[58] Field of Search ..... 62/135, 347, 349, 352

[56] References Cited

U.S. PATENT DOCUMENTS

| | | | |
|---|---|---|---|
| 3,423,952 | 1/1969 | Pugh | 62/347 X |
| 3,791,163 | 2/1974 | Dickson et al. | 62/347 |
| 3,877,242 | 4/1975 | Creager | 62/352 X |
| 4,617,806 | 10/1986 | Sakai et al. | 62/347 |

*Primary Examiner*—William E. Tapolcai

*Attorney, Agent, or Firm*—Wenderoth, Lind and Ponack

[57] ABSTRACT

The present invention provides an ice making machine including an ice making water tank adapted to supply ice making water in circulation to an ice making section during the ice making cycle, a harvesting water tank adapted to supply harvesting water to the ice making section during the harvesting cycle, a compressor adapted to supply refrigerant gas to an evaporator tube of the ice making section, a float switch provided to the harvesting water tank and adapted to sense the upper water limit of the harvesting water, a water feed valve adapted to supply water to the harvesting water tank, and a control circuit having a relay for sensing that the machine is in the ice making cycle, the circuit being connected to the float switch and to the water feed valve for controlling the operation thereof. The water feed valve is open only when an AND output signal of the relay and the float switch is issued.

6 Claims, 2 Drawing Sheets

ICE MAKING MACHINE

BACKGROUND OF THE INVENTION

1. Field of the Invention

This invention relates to an ice making machine and more particularly to an ice making machine wherein feed water is supplied only during the ice making cycle to the deicing or harvesting water tank for improving temperature characteristics of the harvesting water.

2. Description of the Prior Art

There have been adopted and proposed various constructions of this kind of the ice making machines. Typical of these is an ice making machine shown and described in Japanese Utility Model Publication No. 38692/1984.

In the ice making machine of Publication No. 38692/1984, when the harvesting water should be decreased from a predetermined water level which is the full water level, it is sensed by a foot switch which then issues an output signal for opening a magnetic valve connected to an external water source or water main for supplying water from the water main into the harvesting water tank. When the water is supplied in this manner, the temperature of the harvesting water is lowered. Thus, when the harvesting water is sprayed onto the freezing plates, it takes a lot of time before the harvesting of ice products from the freezing plates is terminated, so that the operational efficiency of the ice making machine is lowered.

In order to combat this, it is a conventional practice to design the harvesting water tank to be extremely large to prevent rapid falls in the temperature of the harvesting water due to introduction of the low temperature feed water. However, this turns out to be a barrier to reducing the size of the ice making machine.

Conversely, when the harvesting water tank is designed to be extremely small, the harvesting water temperature is significantly lowered in winter so that a large size heat exchanger is required in order to keep the harvesting water temperature at a predetermined value. On the other hand, the water temperature in the harvesting water tank is unusually increased during summer with resulting increase in the costs involved in surface treatment of the heat exchanger provided in the harvesting tank and heat resisting treatment of the harvesting water tank itself. In addition, harvesting water of an unusually high temperature is supplied to the freezing plates during harvesting so that the yield of the ice products is lowered due to excess ice melting. Since the harvesting water is used as the ice making water in the next ice making cycle, the ice making water at the next ice making cycle is at an elevated temperature, resulting in a decreased yield in ice products. Such reduction in the ice making capacity represents an increase in the load on the freezing device thus leading to shortened service life of the freezing device.

SUMMARY OF THE INVENTION

It is a principal object of the present invention to provide an ice making machine, which is highly suitable for overcoming the aforementioned difficulties.

In view of this object, the present invention provides an ice making machine comprising an ice making water tank for supplying ice making water in circulation to an ice making section during the ice making cycle, a harvesting water tank for supplying harvesting water to the ice making section during the harvesting cycle, a compressor for supplying a refrigerant gas to an evaporator tube of the ice making section, means provided in said harvesting water tank for sensing the upper water level limit of the harvesting water, a valve for supplying feed water to said harvesting water tank, and control means including ice making cycle sensing means for sensing that the machine is in the ice making cycle, said control means being connected to said water level sensing mean and said feed water valve for controlling the operation of said sensing means and said feed water valve.

The feed water valve is open only during the ice making cycle and remains completely closed during the harvesting cycle so that water is supplied into the harvesting water tank only during the ice making cycle. More specifically, the feed water valve is opened to permit water to be supplied into the harvesting water tank only when an AND output is issued indicating that the amount of the harvesting water in the harvesting water has decreased to cause the water level sensing means to be actuated, while simultaneously the ice making cycle has been initiated to cause the ice making cycle sensing means to be actuated (the time the AND output is issued corresponding to the time of starting of the ice making cycle starts).

BRIEF DESCRIPTION OF THE DRAWINGS

For a better understanding of the invention, reference may be made to the preferred embodiment, exemplary of the invention, shown in the accompanying drawings, in which.

DESCRIPTION OF THE PREFERRED EMBODIMENT

Figure 1:
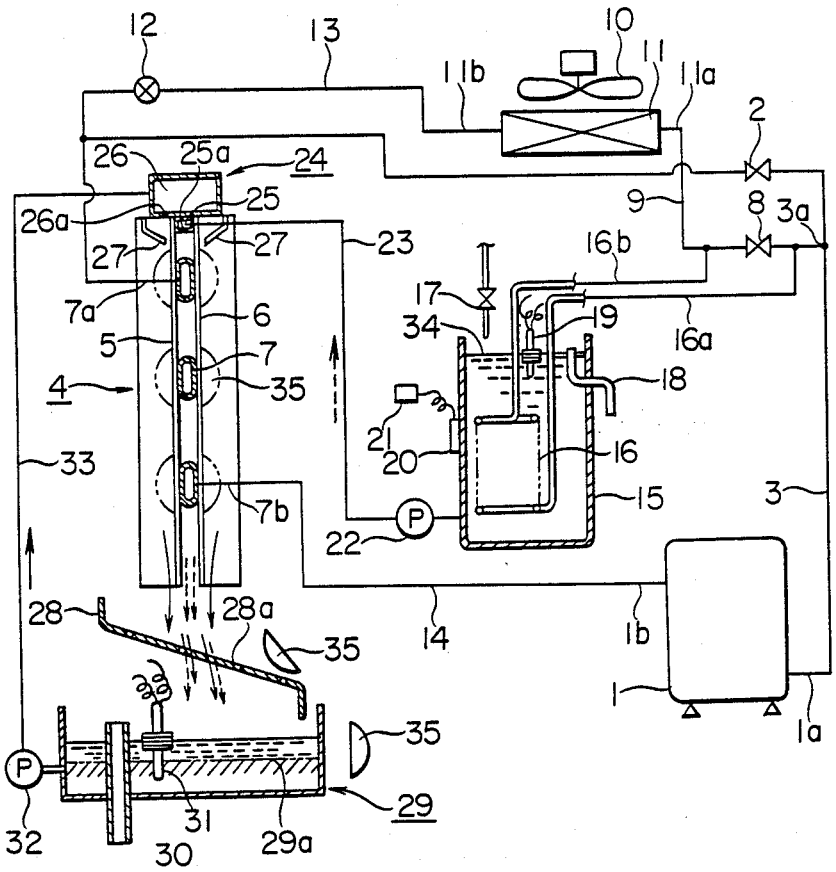
FIG. 1 is a schematic overall view showing the construction of the ice making machine of the present invention, inclusive of a freezing circuit and a water circuit.
Figure 3:
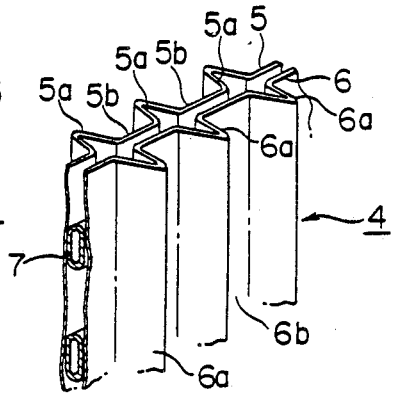
FIG. 3 is a perspective view showing a portion of the freezing plates employed in the ice making machine of FIG. 1.

Referring now to the drawings, and particularly to FIG. 1, there are illustrated a freezing circuit and a water circuit according to a preferred embodiment for the ice making machine of the present invention, wherein a compressor 1 has its discharge side 1*a* connected via a first connection line 3 having a hot gas valve 2 to an inlet 7*a* of an evaporator tube 7 that is sandwiched between freezing plates 5, 6 of a freezing section 4 having a plurality of ribs 5*a* 6*a*, respectively, as shown in FIG. 3. A second connection line 9 having a bypass valve 8 is branched from a junction 3*a* that is provided ahead of the hot gas valve 2 in the first connection line 3. The second connection line 9 is connected to an inlet ll*a* of a condenser 11 that is air-cooled e.g., by a motor-driven fan 10. A third connection line 13 connected to an outlet 11*b* of the condenser 11 and having an expansion valve 12 is united with the first connection line 3 and connected to the inlet 7*a* of the evaporator tube 7.

The evaporator tube 7 has its outlet 7*b* connected via a fourth connection line 14 to the suction side 1*b* of the compressor 1, while an inlet line 16*a* and an outlet line 16*b* communicating with a heat exchanger 16 provided in a harvesting water tank 15 are connected to the second connection line 9 at both sides of the bypass valve 8.

Water is supplied from an external supply source into the harvesting water tank 15 through a water feed valve 17 provided thereabove. An overflow tube 18 and a float switch 19 are provided to the harvesting water tank 15, while a temperature sensor 21 having a temperature sensing element 20 is provided outside of the tank for sensing the temperature of the harvesting water.

A harvesting water supply line 23 having a harvesting water pump 22 is connected to near the bottom of the harvesting water tank 15 and to a harvesting water conduit 25 of a water sprayer 24 fitted to the upper end of the freezing plates 5 and 6. The harvesting water is supplied in a direction indicated by the dotted line in FIG. 1 and sprayed onto the reverse sides of the freezing plates 5, 6 through a plurality of water spray apertures 25*a* in the harvesting water conduit 25. The water sprayer 24 also has an ice making water conduit 26 above and integral with the harvesting water conduit 25. The ice making water is supplied via ice making water spray apertures 26*a* in the ice making water conduit 26 to the surfaces of the freezing plates 5, 6, that is, freezing surfaces 5*b*, 6*b*, via a spray water guide plate 27.

Below the freezing section 4, there are provided a drain board 28 having a plurality of water guide apertures 28*a* extending therethrough and a freezing water tank 29 in which there are provided an overflow tube 30 and a float switch 31. The ice making water in the ice making water tank 29 is supplied to the ice making water conduit 26 via an ice making water supply line 33 provided in the vicinity of the bottom of the tank and having an ice making water circulation pump 32.

Figure 2:
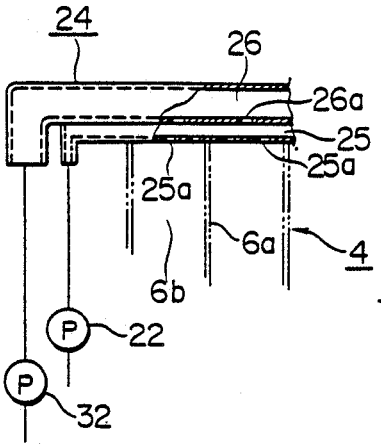
FIG. 2 is an enlarged front view, shown partially in cross section, and showing a portion of the water sprayer employed in the ice making machine shown in FIG. 1.

The detailed structure of the water sprayer 24 as known per se is shown in FIG. 2 wherein the ice making water conduit 26 and the harvesting water conduit 25 are formed integrally with each other in an upper tier and a lower tier, respectively, extending along the length of the freezing plates 5, 6.

Figure 4:
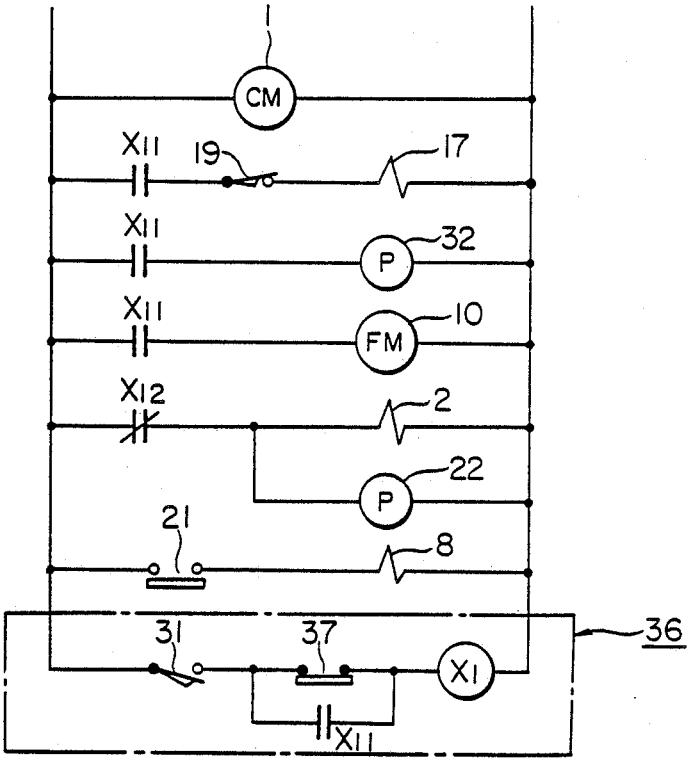
FIG. 4 is a diagram showing the control circuit for the feed water valve associated with the harvesting water tank.

The operation of the ice making machine according to the present invention will be explained by referring to FIGS. 1 and 4.

With the float switch 31 of the ice making water tank 29 being ON and with a known end-of-harvesting sensing means 37 such as a thermostat, associated with the freezing section 4 being also ON, that is, with no ice deposited on the freezing plates, a power source, not shown, is turned on, whereby an ice making cycle sensor, such as relay $X_1$, is energized for closing its normally open contact $X_{11}$, the compressor 1 and the fan 10 thus starting their operation. The refrigerant is supplied via connection lines 3 and 9, condenser 11, connection line 13 and the expansion valve 12 to the inlet 7*a* of the evaporator 7 to start the cooling of the freezing plates 5, 6. Simultaneously, the ice making cycle is started and ice making water circulation pump 32 starts its operation, with the ice making water flowing down along the ice making surfaces 5*b*, 6*b* of the freezing plates 5, 6 as it is supplied thereto from the ice making water conduit 26 by way of the ice making water spray apertures 26*a* and the spray water guide plate 27.

The water feed valve 17 adapted for supplying harvesting water to the harvesting water tank 15 is connected to a control circuit 36 in such a fashion that it is opened only under an AND status of an output ON signal from the float switch 19 and an ON signal from a contact $X_{11}$ of the relay $X_1$ provided to a control circuit 36 for sensing that the ice maker is in the ice making cycle. The float switch 19 senses an upper limit water level 34 in the harvest water tank 15 and issues an ON signal when the amount of harvesting water decreases. The opened state of the water feed valve 17 is continued until the float switch 19 senses the upper limit water level 34 indicating the water volume sufficient for the next ice making cycle.

When the temperature sensor 21 for sensing the temperature of the harvesting water in the harvesting water tank 15 senses the water temperature not higher than the predetermined water temperature, the contact of the temperature sensor 21 is turned off so that the bypass valve 8 is closed. The refrigerant gas from compressor 1 is supplied under elevated temperature and pressure to the heat exchange with the low temperature harvesting water in the harvesting water tank 15, with the harvesting water and the high pressure refrigerant gas being thereby heated and cooled, respectively. Therefore, with the construction of the conventional ice making machine designed on the basis of the heat exchange area at the time of ice formation when the heat exchange at the freezing plates 5, 6 falls to a low level indicating a low freezing load, the peak values of the freezing load appear during the initial stage of water cooling with a higher freezing load, or after about five minutes since the start of the ice making cycle, such that an excess capacity of the condenser 11 need be provided t deal with the peak values of the freezing load for only a short time. According to the present invention, the condenser 11 can be reduced in size because the heat exchange that takes place in the harvesting water tank 15 with the lower temperature harvesting water.

With the progress in the aforementioned ice making cycle, ice products 35 start to be formed gradually on the ice making surfaces 5*b*, 6*b* of the freezing plates 5, 6. As the temperature of the harvesting water in the harvesting water tank 25 reaches a predetermined value, the contact of the temperature sensor 21 is turned on so that the bypass valve 8 is opened. With the bypass valve 8 being thus opened, most of the high temperature and pressure refrigerant gas from compressor 1 flows to condenser 11 via bypass valve 8, with only a small portion of the refrigerant gas flowing to the heat exchanger 16. This flow state of the refrigerant gas can be achieved by setting the conduit fluid resistance of the bypass valve 8 side conduit to be lower than that of the conduit in the heat exchanger 16. To this end, a straight tube may be used as the bypass valve 8 conduit for facilitating the passage of the refrigerant gas therethrough, or the line including the bypass valve 8 may be selected to be significantly shorter in length than the line in the heat exchanger 16.

As described above, when the water temperature in the harvesting water tank 15 becomes higher than a predetermined temperature, the bypass valve 8 remains open and the ice making cycle proceeds. With further progress in the ice making cycle, the ice making water in the ice making water tank 29 reaches its lower level, at which time the float switch 31 is turned off, and the end-of-ice-making signal is issued. In this state, a number of ice products 35 that have grown to a predetermined size are formed on the freezing plates 5, 6.

Meanwhile, when the end-of-ice-making signal is issued, relay $X_1$ of the control circuit 36 is deenergized so that the normally open contacts $X_{11}$ are opened to terminate the operation of the fan motor and the ice making water circulation pump 32. On the other hand, the normally closed contact $X_{12}$ is closed to open the hot gas valve 2 so that the hot gas is supplied to the evaporator tube 7 while by-passing the condenser 11. Simultaneously, the harvesting water pump 22 is actuated. With actuation of the harvesting water pump 22, the harvesting water in the harvesting water tank 15 starts to be supplied by way of the harvesting water supply line 23 and water spray apertures 25*a* in the harvesting water conduit 25 to the reverse sides of the freezing plates 5, 6 to start the harvesting cycle.

During this harvesting cycle, the amount of harvesting water in the harvesting water tank 15 decreases gradually from its upper limit water level 34. However, the water feed valve 17 is open only when both the contact $X_{11}$ of the relay $X_1$ and the float switch 19 are open resulting in the issuance of the AND output, that is, only during the ice making cycle, as described hereinabove, so that the water feed valve 17 is not opened even when the amount of water in the harvesting water tank 15 should be significantly reduced during the harvesting cycle.

With the progress in the harvesting cycle, the freezing plates 5, 6 are warmed by the hot gas and the harvesting water, so that the ice products 35 are detached from the ice making surfaces 5*b*, 6*b* of the freezing plates 5, 6 to be stored in an ice reservoir, not shown.

The harvesting water sprayed from the harvesting water conduit 25 flows down into the ice making water tank 29 by way of the reverse sides of the plates 5, 6 and water guide apertures 28*a* of the drain board 28 so as to be stored therein as ice-making water that is required for the next ice making cycle. As a result, the float switch 31 is turned on. Any redundant water is discharged to the outside by way of the overflow tube 30.

When the end-of-harvesting sensor 37 senses that all the ice products 35 have been detached from the freezing plates 5, 6, that is, when the end-of-harvesting sensor 37 is turned on, the normally closed contact $X_{12}$ of the relay $X_1$ is opened, so that the hot gas valve 2 is opened in a known manner. The operation of the harvesting water pump 22 ceases while the operation of the fan motor and the ice making water circulation pump 32 is started to enter into the next ice making cycle.

As described above, when the ice making cycle is started again, both the contact $X_{11}$ of the ice making cycle sensor $X_1$ and the float switch 19 are turned on so that an AND output is issued from the AND circuit consisting of the contact $X_{11}$ and the float switch 19, and the water feed valve 17 is opened to permit the water to be supplied into the harvesting water tank 25.

The ice maker of the present invention can therefore successively make ice by the repetition of the above described ice making and harvesting cycles.

In the present embodiment, a series connection of the float switch 29 and the contact $X_{11}$ is used as means for opening the water feed valve 17. As an alternative, a similar operation can also be achieved by using an integrated circuit making use of known logic circuits.

With the above described construction and operation of the ice maker of the present invention, the harvesting water is supplied only during the ice making cycle such that the harvesting water heated by the heat exchanger in the harvesting water tank during the ice making cycle is not cooled by the feed water during the harvesting cycle, but is maintained at an elevated temperature thus resulting in an efficient harvesting without it being necessary to perform control operations such as heating depending upon changes in the harvesting water temperature.

Also, since the water is not supplied into the harvesting water tank during the harvesting cycle, the harvesting water is not substantially lowered in temperature so that it is not necessary to heat the water by heating means to a temperature higher than the required temperature, resulting in an improved condensation effect and a relatively low temperature of the water supplied as ice making water thus giving rise to energy saving and improved ice making operation capabilities.

As a further subsidiary effect, the harvesting water newly supplied into the harvesting water tank acts as effective cooling water with respect to the heat exchanger during the early stage of the ice making cycle when the freezing load is high, so that the refrigerant gas flowing through the heat exchanger is effectively cooled. The result is a reduced condenser load and a reduction in the size of the condenser.

It will be apparent that many modifications and variations are possible in light of the above teachings. It therefore is to be understood that within the scope of the appended claims, the invention may be practiced other than as specifically described.

What we claim is:

1. An ice making machine comprising:

an ice making section having an evaporator connected in heat exchange relation therewith;

an ice making water tank adapted for storing ice making water supplied in circulation to said ice making section during the ice making cycle;

a harvesting water tank adapted for storing harvesting water supplied to said ice making section during the harvesting cycle;

a compressor for supplying refrigerant gas to said evaporator;

means provided in said harvesting water tank for sensing the upper water level limit of the harvesting water;

a water feed valve for feeding water to said harvesting water tank;

control means including an ice making cycle sensing means adapted for sensing that the machine is in the ice making cycle thereof, said control means being connected to said means for sensing the upper water level limit and to said water feed valve for controlling the operation of said upper limit sensing means and said water feed valve; and said water feed valve being opened only during the ice making cycle when said ice making cycle sensing means and said upper limit sensing means issue an AND output.

2. The ice making machine according to claim 1, wherein said ice making cycle sensing means is a relay having its normally open contact connected in series with said upper limit sensing means.

3. The ice making machine according to claim 2, wherein said control means comprises end-of-ice-making sensing means and end-of-harvesting sensing means connected together in series with said ice making cycle sensing means, said ice making cycle sensing means being turned-off upon completion of ice making and turned-on upon completion of preparation for ice making, said end of harvesting sensing means being turned-on upon sensing the completion of harvesting, said ice making cycle sensing means sensing the turned on states of the end-of-ice-making cycle sensing means and the end-of-harvesting sensing means as the ice making cycle.

4. The ice making machine according to claim 3, wherein said end-of-ice-making sensing means is water level sensing means provided in said ice making water tank and adapted for sensing the water level therein of the ice making water, said water level sensing means being turned off at the lower water level limit corresponding to the end of ice making and turned on when the water level is between said lower limit and said upper limit corresponding to the end of the preparation for ice making.

5. The ice making machine according to claim 4, wherein said water level sensing means is a float switch.

6. The ice making machine according to claim 4, wherein another normally open contact of the relay is connected in parallel with said end-of-harvesting sensing means.

* * * * *